US011345139B2

(12) United States Patent
Manzini et al.

(10) Patent No.: US 11,345,139 B2
(45) Date of Patent: May 31, 2022

(54) SYSTEM FOR REGISTERING THE PRINTING UNITS OF A ROTARY PRINTING MACHINE WITH MANUALLY-ADJUSTABLE PRINT REGISTER

(71) Applicant: OMET S.r.l., Lecco (IT)

(72) Inventors: Amerigo Manzini, Lecco (IT); Gianni Gerosa, Lecco (IT)

(73) Assignee: OMET S.r.l., Lecco (IT)

( * ) Notice: Subject to any disclaimer, the term of this patent is extended or adjusted under 35 U.S.C. 154(b) by 0 days.

(21) Appl. No.: 15/564,209

(22) PCT Filed: Apr. 7, 2016

(86) PCT No.: PCT/IB2016/051962
§ 371 (c)(1),
(2) Date: Oct. 4, 2017

(87) PCT Pub. No.: WO2016/162811
PCT Pub. Date: Oct. 13, 2016

(65) Prior Publication Data

US 2018/0126723 A1 May 10, 2018

(30) Foreign Application Priority Data

Apr. 10, 2015 (IT) ..... 102015000011486

(51) Int. Cl.
*B41F 13/14* (2006.01)
*B41F 33/00* (2006.01)
*B41F 33/02* (2006.01)

(52) U.S. Cl.
CPC ..... *B41F 13/14* (2013.01); *B41F 33/0081* (2013.01); *B41F 33/02* (2013.01);
(Continued)

(58) Field of Classification Search
CPC ..... B41F 13/14; B41F 33/0081; B41F 33/02; B41P 2213/90; B41P 2233/13; B41P 2233/52
See application file for complete search history.

(56) References Cited

U.S. PATENT DOCUMENTS 4,391,190 A * 7/1983 Metzler ..... B41F 13/025 101/181
5,056,430 A 10/1991 Bayerlein et al.
(Continued)

FOREIGN PATENT DOCUMENTS

DE 102012110910 A1 5/2014

*Primary Examiner* — David H Banh
(74) *Attorney, Agent, or Firm* — ArentFox Schiff LLP; Michael Fainberg

(57) ABSTRACT

The machine comprises: a plurality of printing units each of which has a printing cylinder movable so as to allow adjustment of the position of the image printed by that cylinder in two perpendicular adjustment directions relative to the web of printing material; first manually-operated adjustment means arranged to allow a user to adjust manually the position of each printing cylinder; image acquisition means arranged to acquire images of register marks printed by the printing units along one or both sides of the web of material; and display means arranged to show, on an enlarged scale, the images acquired by the image acquisition means, so as to allow the user to detect any misalignments between the register marks and to properly adjust the position of one or more printing cylinders to clear said misalignments. The image acquisition means comprise a plurality of cameras each of which is arranged to frame.

5 Claims, 5 Drawing Sheets

(52) U.S. Cl.
CPC ..... *B41P 2213/90* (2013.01); *B41P 2233/13* (2013.01); *B41P 2233/52* (2013.01)

(56) References Cited

U.S. PATENT DOCUMENTS 5,320,040 A * 6/1994 Simeth ..... B65H 9/04 101/232
5,459,941 A * 10/1995 Lowe ..... H05K 3/1216 33/620
5,572,433 A * 11/1996 Falconer ..... B65H 23/046 226/2
5,794,829 A * 8/1998 Perrault ..... B41F 13/025 226/18
5,828,075 A * 10/1998 Siler ..... B41F 33/0081 250/559.44
5,917,192 A * 6/1999 Siler ..... B41F 33/0081 250/559.44
7,337,035 B2 * 2/2008 Muller ..... B41F 13/12 700/125
2001/0022143 A1 * 9/2001 Stern ..... B41F 13/025 101/248
2002/0026879 A1 3/2002 Goldstein
2003/0010235 A1 * 1/2003 Siler ..... B41F 13/025 101/180
2004/0163562 A1 * 8/2004 Lewis, Jr. ..... B41F 33/0081 101/485
2011/0074860 A1 * 3/2011 Saettel ..... B41J 2/175 347/19
2011/0074861 A1 * 3/2011 Saettel ..... B41J 2/2135 347/19
2014/0083316 A1 3/2014 Choi et al.
2015/0033968 A1 2/2015 Derichs et al.
2018/0126723 A1 * 5/2018 Manzini ..... B41F 33/0081

* cited by examiner

SYSTEM FOR REGISTERING THE PRINTING UNITS OF A ROTARY PRINTING MACHINE WITH MANUALLY-ADJUSTABLE PRINT REGISTER

CROSS-REFERENCE TO RELATED APPLICATIONS

This application is the U.S. National Stage Application of International Patent Application No. PCT/IB2016/051962, filed on Apr. 7, 2016, which claims priority to Italian Patent Application No. 102015000011486, filed on Apr. 10, 2015, the contents of each of which is incorporated herein by reference in its entirety.

TECHNICAL FILED

The present invention relates in general to a rotary printing machine with manually-adjustable print register, wherein the machine comprises a plurality of printing units, one for each colour, and wherein the relative position of the printing cylinders (also referred to as cliché-carrying cylinders) of the printing units is manually adjustable by the user to ensure proper registering of the machine. More particularly, the present invention relates to a system for registering the printing units of a machine of the above-identified type.

BACKGROUND

As is known, in a rotary printing machine with manually-adjustable print register the registering operation is carried out by the user by adjusting the position of the printing cylinder of each printing unit so as to displace the image printed by that cylinder in two perpendicular directions (namely, in a longitudinal direction, i.e. in the forward direction of the web of material, and in a transverse direction, i.e. in a direction perpendicular to the forward direction of the web of material) relative to the web of printing material until the register marks (also known as "print marks") which are printed by each printing unit near each of the two sides of the web of material are aligned with each other. To this end, each printing unit is provided with adjustment mechanisms for adjusting the position of the printing cylinder, and hence of the image printed by that cylinder, in the two adjustment directions defined above relative to the web of printing material. These adjustment mechanisms may be simply manually-operated mechanisms, for example mechanisms operable by means of a pair of wheels each of which allows the user to adjust the printing cylinder in a respective adjustment direction, or electrically-operated mechanisms, in which case electric motors are controlled by the user via special control members, such as for example buttons and/or handles.

The correct registering of the machine is obtained when the register marks printed by all the printing units are perfectly aligned with each other. The position of the printing cylinder of each printing unit is adjusted by the user by suitably maneuvering the above-mentioned control members, for example by rotating in either direction a pair of handles, each associated to a respective one of the two adjustment directions. As clearly results from the above explanations, the term "manual adjustment of the print register" is to be intended as referring to a mode for adjusting the print register in which it is the user, and not an automatic control system, that controls (by means of adjustment mechanisms manually operated by the user or by electric motors controlled by the user) the displacement of the printing cylinders of the printing units to register the machine.

In order to allow the user to check the correct alignment of the register marks, the machine is provided with a camera that is positioned downstream of the last printing unit and allows to show on a special display, on an enlarged scale, the register marks printed by all the printing units. Several register marks are usually present on the developed printed image, typically three register marks on each side, wherein the middle register mark is often used as reference mark for checking the correct registering of the printing units of the machine, while the first register mark and the last register mark basically serve to check the correct mounting of the printing plate. The camera placed at the end of the line has therefore to frame and show on the display only the middle register mark that is printed at each step by each printing unit. To this end, the web of printing material has also, printed thereon near the middle register mark, an identifying mark which can be read by a photocell and the printing machine is also provided with a photocell having the function of detecting each time the presence of an identifying mark to warn the camera of the presence of a register mark to be displayed.

Therefore, the user can watch on the display, superimposed on one another, the register marks that have been printed by all the printing units and are at that time framed by the camera and can manually correct the position of each printing unit until the respective register mark (which is recognizable by its colour) is brought into perfect alignment with the other marks.

The registering operation is carried out first with the machine working at low speed, in order to reduce the amount of scrap material that is inevitably produced during this phase. Upon completion of the low-speed initial registering operation, the printing machine is set to work at a higher speed, typically at the normal working speed, and the registering operation is repeated, since the change in the operating conditions of the machine usually results in a small register error affecting all the printing units.

Such a registering mode suffers from a number of disadvantages.

First of all, in order for the user to be able to check the effect of the correction of the position that has been made each time on a printing unit the user has to wait until the material that has been printed by that printing unit after the correction reaches the camera. The waiting time obviously depends both on the length of printing material that is comprised between the camera and the printing unit on which the user is acting and on the speed with which the material is fed. Since the registering operation is initially carried out at low speed, the waiting time required to check the effect of each correction is correspondingly long and the amount of web of print material to be scrapped is correspondingly large. Moreover, since the correction of the position of each printing unit is carried out manually by the user based only on the visual assessment of the misalignment of the associated register mark relative to the other ones, the user is typically unable to obtain a perfect registering at his first attempt, but has to make several corrections on each printing unit.

Furthermore, as the number of printing units to be adjusted increases, also the number of register marks to be aligned with each other increases. The superimposition of marks of different colours makes it difficult for the user to distinguish one colour from another, which causes a further increase in the time required and in the amount of scrap material produced.

Accordingly, the registering operation of the machine is nowadays very expensive, both in terms of time and in terms of scrap material produced.

SUMMARY

It is an object of the present invention to overcome the drawbacks of the prior art discussed above, by making it possible to carry out the registering operation of the printing units of a rotary printing machine with manually-adjustable print register in a shorter time and with a smaller amount of scrap material than the prior art.

This and other objects are fully achieved according to the present invention by virtue of a printing machine having the characteristics set forth in independent claim 1.

Advantageous embodiments of a printing machine according to the invention and advantageous ways of carrying out a method according to the invention are defined in the dependent claims, the subject-matter of which is to be intended as forming an integral and integrating part of the following description.

In short, the invention is based on the idea of providing a plurality of cameras, each of which is arranged to frame, after a respective printing unit, the portion of web material where the register marks are printed. Preferably, the printing machine is provided with one camera for each printing unit starting from the second one (where the term "second" refers to the order with which the printing units are positioned in the forward direction of the web of material along the machine). The user is thus able to watch each time on the display the image of the register marks printed by the printing units upstream of a given camera and hence to detect any possible misalignments between the register mark printed by the last printing unit and the one(s) printed by the preceding printing unit(s).

Compared to the prior art, where the user is obliged to wait a long time before checking the effect of a correction made on a given printing unit (which time depends on the position of the printing unit on which the user is acting and on the forward speed of the web of printing material), in a machine according to the invention this check can be made in a shorter time and hence with a smaller amount of scrap material. Where each printing unit is provided with a camera, the check is made substantially in real time, since the camera acquires the image of the web of material immediately downstream of the printing unit on which the user is acting. Moreover, since only the register marks printed by the printing units upstream of a given camera are shown on the display, it is possible to distinguish more easily the register mark printed by the printing unit that is being adjusted and therefore to make the registering of each printing unit easier and quicker. A significant reduction in the time required to carry out the registering operation on all the printing units of the machine and in the amount of scrap material produced during this operation is thus obtained.

BRIEF DESCRIPTION OF THE DRAWINGS

Further characteristics and advantages of the present invention will become more apparent from the following detailed description, given purely by way of non-limiting example with reference to the appended drawings, where.

DETAILED DESCRIPTION

Figure 1:
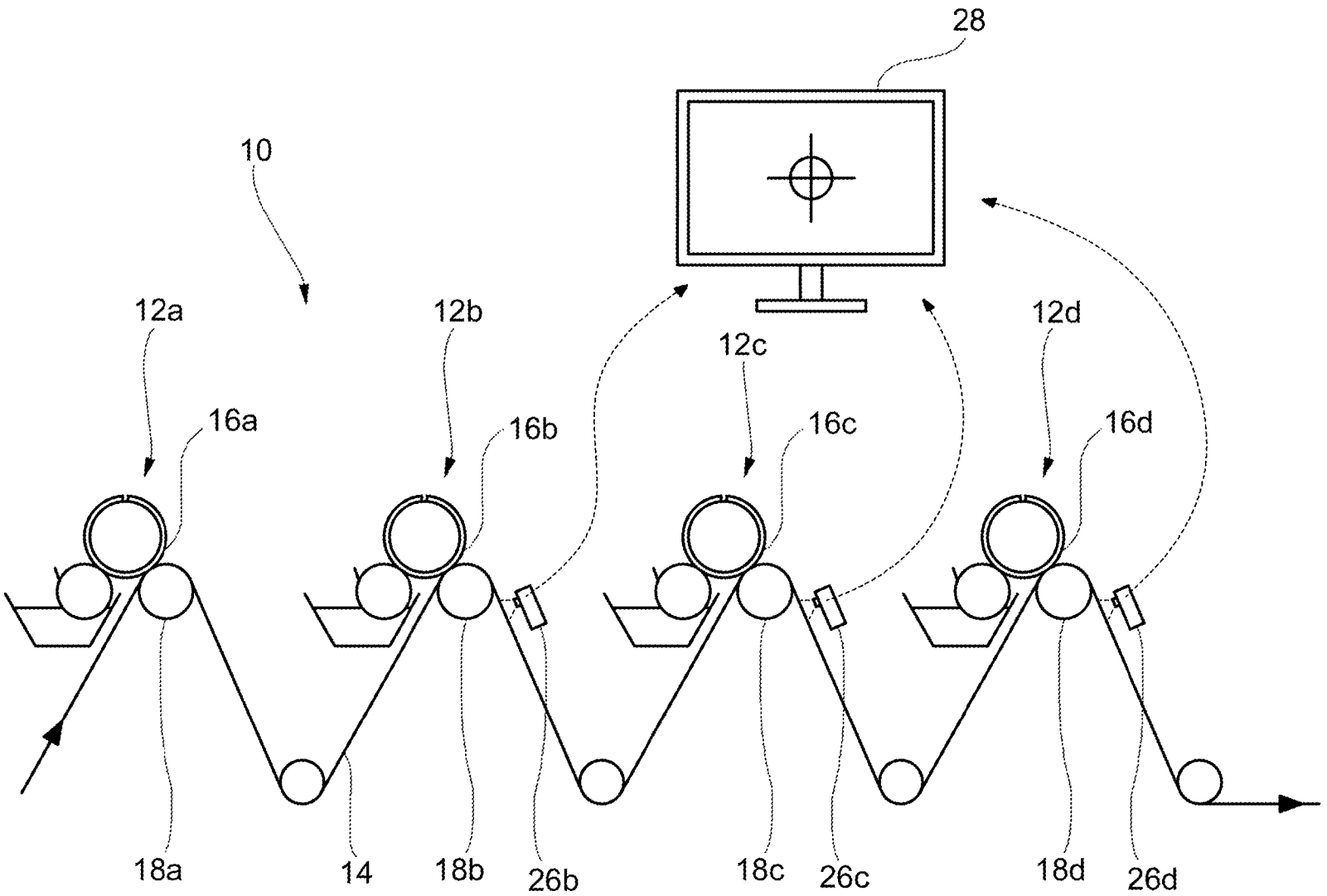
FIG. 1 is a front schematic view of a rotary printing machine provided with a system for manual registering of the printing units of the machine according to the present invention.
Figure 2:
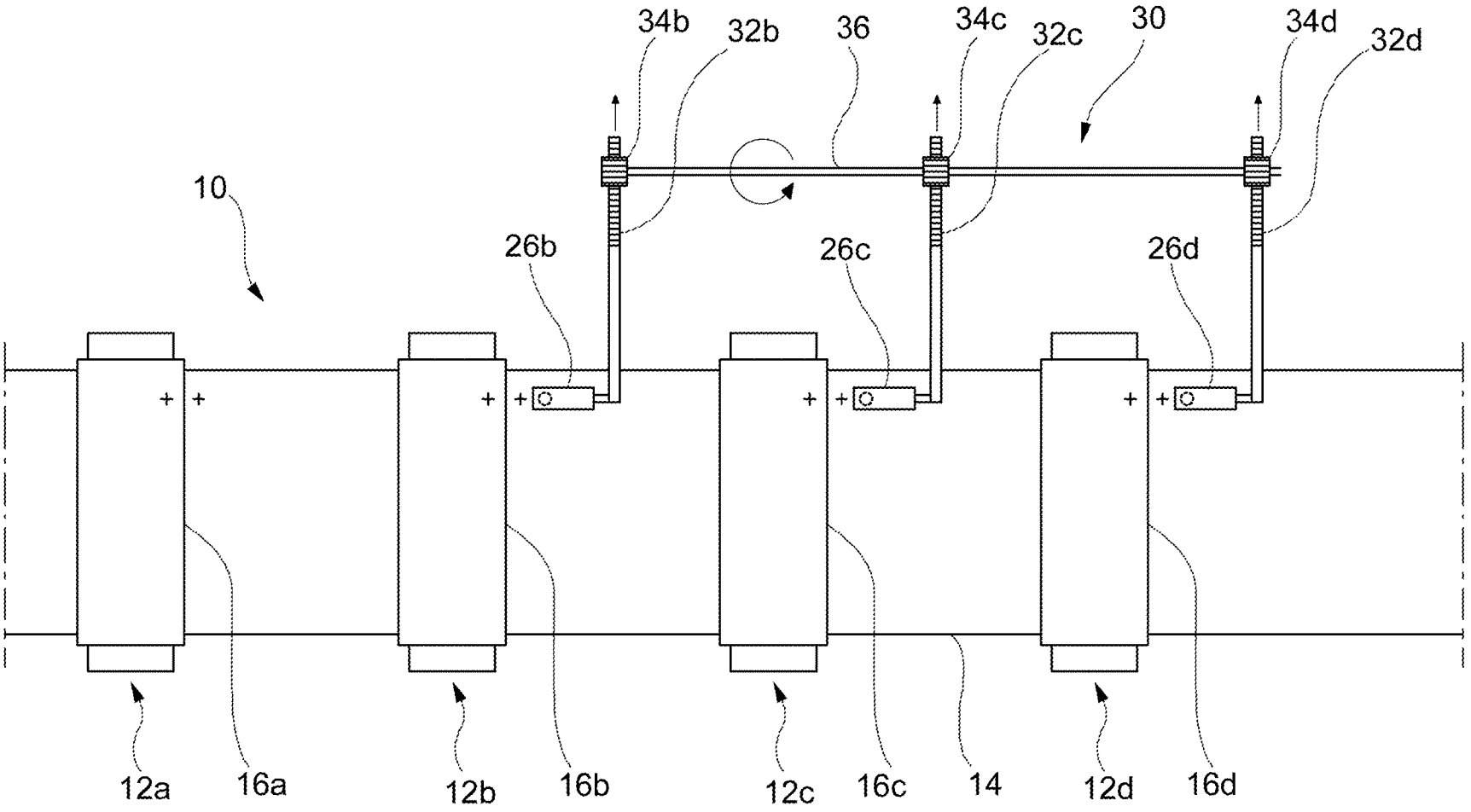
FIG. 2 is a schematic view from above of the machine of FIG. 1.

With reference first to FIGS. 1 and 2, a rotary printing machine with manually-adjustable print register (hereinafter simply referred to as "printing machine") according to an embodiment of the present invention is generally indicated 10. The printing machine 10 comprises a plurality of printing units 12, which are of per-se-known type and will not therefore be described in detail here. Each printing unit 12 is arranged to transfer on a web of printing material 14 images and/or characters of a given colour, the final image resulting therefore from the superimposition of the images of various colours printed by the various printing units 12. In the embodiment illustrated in FIGS. 1 and 2 the printing machine 10 comprises four printing units, indicated 12*a*, 12*b*, 12*c* and 12*d*, respectively, but the invention is clearly applicable to a printing machine having any other number of printing units. In per-se-known manner, each printing unit 12*a*, 12*b*, 12*c* and 12*d* comprises a printing cylinder indicated 16*a*, 16*b*, 16*c* and 16*d*, respectively, and an impression cylinder indicated 18*a*, 18*b*, 18*c* and 18*d*, respectively (FIG. 1).

Figure 3:
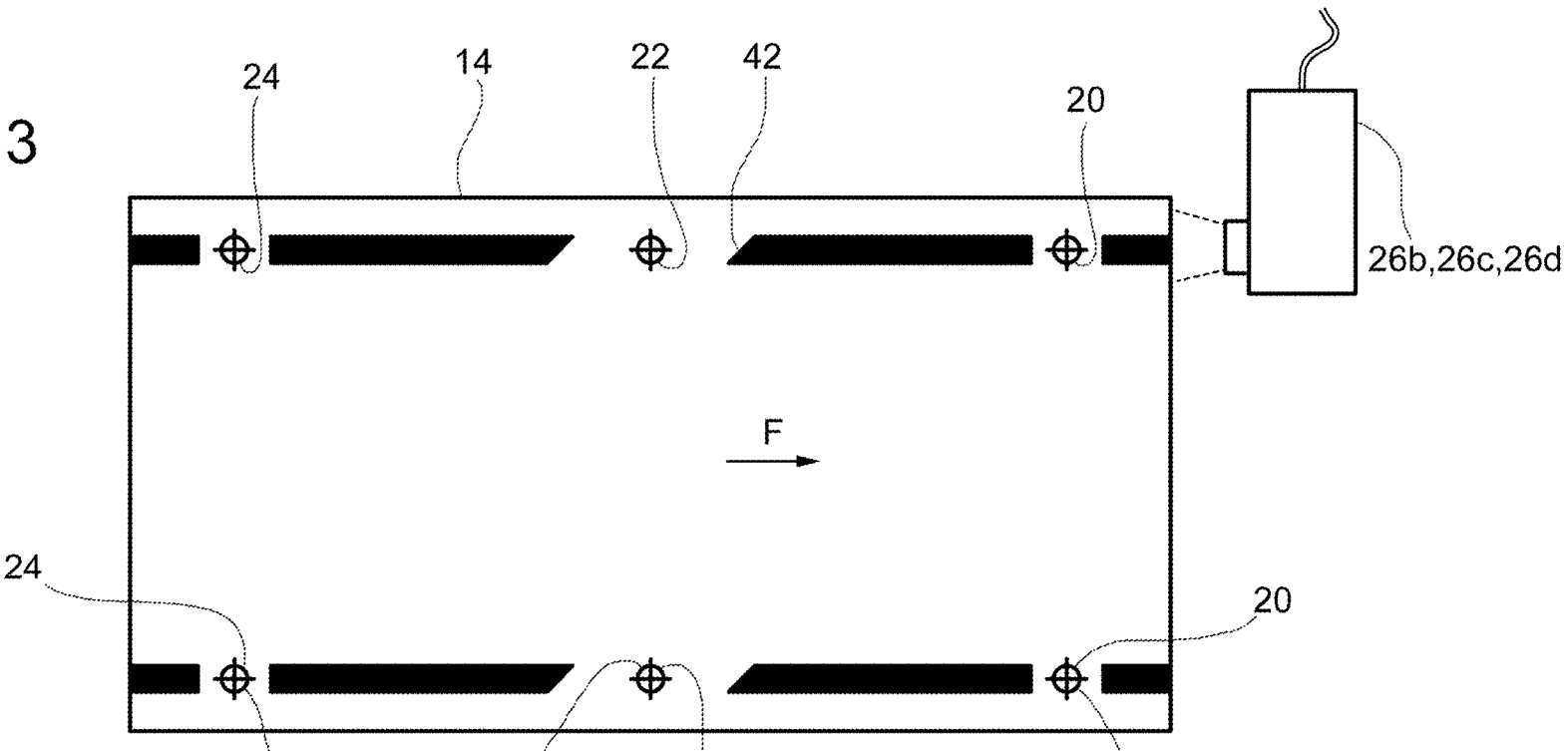
FIG. 3 shows the development of the printing plate of one of the printing units of the machine of FIG. 1, where the register mark to be framed by the camera is identified by means of a special identifying mark.
Figure 4:
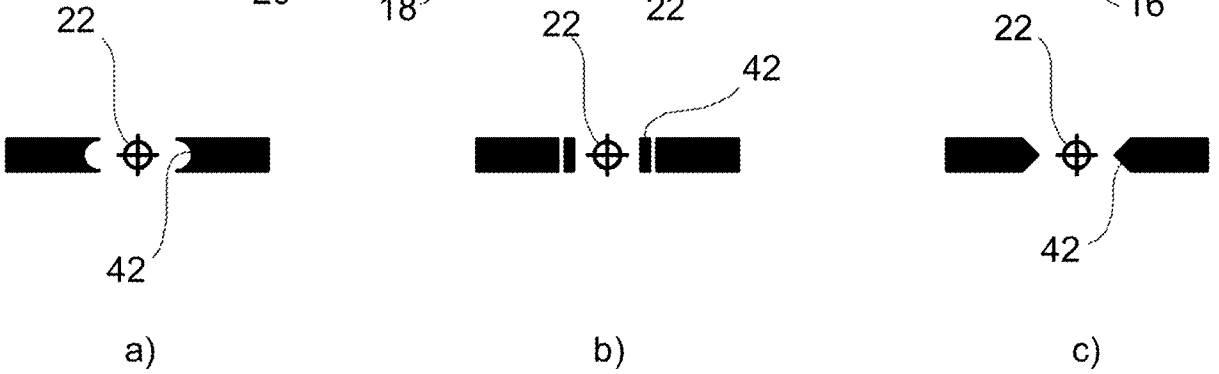
FIGS. 4*a*, 4*b* and 4*c* show further examples of identifying marks that can be used in a printing machine according to the invention.

As shown in FIG. 3, each printing unit 12*a*, 12*b*, 12*c* and 12*d* is arranged to print on the web of material 14 not only the characters and/or images (not shown in FIG. 3) intended to define the final image, but also a plurality of register marks along the two sides of the web of material 14. Typically, as in the illustrated embodiment, each printing unit 12*a*, 12*b*, 12*c* and 12*d* is arranged to print three register marks, indicated 20, 22 and 24, respectively, for each side of the web of material 14, wherein the middle register mark 22 is generally, though not necessarily, the only one to be used as reference mark for checking the correct registering of the printing units of the machine, while the first register mark 20 and the last register mark 24 (with reference to the forward direction of the web of material along the machine, indicated by arrow F in FIG. 3) normally serve to check the correct mounting of the printing plate.

As stated in the introductory part of the description, the registering operation of the machine 10 is carried out by the user by manually adjusting the position of the printing cylinder 16*a*, 16*b*, 16*c* and 16*d* of each printing unit 12*a*, 12*b*, 12*c* and 12*d* so as to displace the image printed by that cylinder in two perpendicular directions, namely in a longitudinal direction (i.e. in the forward direction of the web of material 14) and in a transverse direction (i.e. in a direction perpendicular to the forward direction) relative to the web of material 14, until the register marks 22 that have been printed by the printing units 12*a*, 12*b*, 12*c* and 12*d* are brought into alignment with each other. The correct registering of the machine 10 is obtained when the register marks 22 printed by all the printing units 12*a*, 12*b*, 12*c* and 12*d* are perfectly aligned with each other.

The position of each printing cylinder 16*a*, 16*b*, 16*c* and 16*d* is adjusted by the user by acting on special control members (not shown, but of per-se-known type), for example by rotating in either direction a pair of handles, each of which is associated to a respective one of the two adjustment directions. Naturally, the invention is not limited to a specific mode for manually adjusting the position of the printing units of the machine, but relates in general to a printing machine in which the position of the printing cylinders is adjusted manually under control of the user, instead of automatically under control of an electronic control unit.

In order to allow the user to check quickly, substantially in real time, whether upon correction of the position of the printing cylinder of a printing unit the respective register mark is aligned with the others, and hence whether the printing unit in question is correctly registered, the printing machine 10 further comprises a plurality of cameras, preferably one camera for each printing unit starting from the second one. In the embodiment proposed here, the printing machine 10 comprises a camera 26*b* associated to the second printing unit 12*b*, a camera 26*c* associated to the third printing unit 12*c* and a camera 26*d* associated to the fourth (and last) printing unit 12*d*. As is shown in particular in FIGS. 2, 3 and 5, each of the cameras 26*b*, 26*c* and 26*d* is arranged so as to frame, after the respective printing unit 12*b*, 12*c* and 12*d*, one of the two lateral portions of the web of material 14 to allow the user to watch the register marks 22 printed on the web of material 14 by all the printing units of the machine upstream of that camera.

The image acquired by each of the cameras 26*b*, 26*c* and 26*d* can be shown on a display 28. In this connection, the printing machine may comprise a single display on which there is shown each time the image acquired by the camera associated to the printing unit that is being adjusted by the user or, alternatively, a plurality of displays (one display for each printing unit or, preferably, one display for more printing units).

Figure 6:
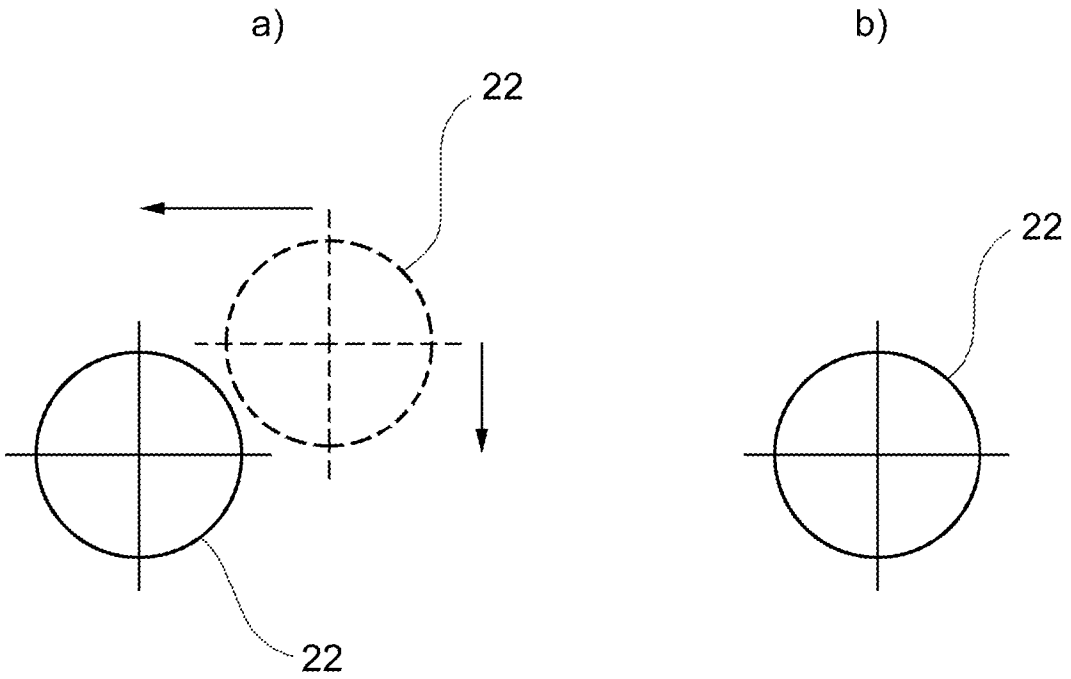
FIGS. 6*a* and 6*b* show the register marks printed by two adjacent printing units of the machine of FIG. 1, in a misaligned condition and in the aligned condition, respectively.

The user is thus able to watch each time on the display 28 the image of the register marks 22 printed by the printing units upstream of a given camera and hence to detect any misalignments between the register mark printed by the last printing unit (namely, by the printing unit that is being adjusted by the user) and the one(s) printed by the preceding printing unit(s). With reference for example to FIGS. 6*a* and 6*b*, the first one shows the image that is shown to the user who is adjusting the position of one of the printing cylinders, for example the position of the printing cylinder 16*b* of the second printing unit 12*b*, on the display 28 in case the register mark 22 (shown in dotted line) printed by the second printing unit 12*b* is not aligned with the register mark 22 (shown in solid line) printed by the first printing unit 12*a*. Observing that image, the user realizes that the position of the printing cylinder 16*b* need to be corrected both in the longitudinal direction and in the transverse direction. FIG. 6*b* shows the image on the display 28 once the printing cylinder 12*b* has been correctly positioned. The register mark 22 printed of the second printing unit 12*b* is now perfectly aligned with the register mark 22 printed by the first printing unit 12*a*.

The cameras 26*b*, 26*c* and 26*d* are mounted on the machine so as to be movable in the transverse direction to ensure the correct alignment between the objective of each camera and the register marks 22 printed by the various printing units 12*a*, 12*b*, 12*c* and 12*d* of the machine on the web of material 14. If, in fact, a web of material is used that has a width different from that of the web of material previously used, the user must adjust the transverse position of the cameras so as to ensure that these latter frame the portion of the web of material on which the register marks are printed. In order to make the adjustment of the transverse position of the cameras easier, the printing machine 10 further comprises a control device, generally indicated 30, arranged to control the simultaneous movement of all the cameras in the transverse direction.

As schematically shown in FIG. 2, the control device 30 may be for example a rack and pinion device, comprising a plurality of racks 32*b*, 32*c* and 32*d*, each of which is drivingly connected for translation in the transverse direction with a respective camera 26*b*, 26*c* and 26*d*, and a corresponding plurality of pinions 34*b*, 34*c* and 34*d*, which are drivingly connected for rotation with each other by means of a shaft 36 and mesh each with a respective rack 32*b*, 32*c* and 32*d*. By controlling the rotation of the shaft 36 with a special control member (not shown), the user is thus able to move simultaneously the cameras 26*b*, 26*c* and 26*d* in the transverse direction.

Naturally, control devices different from the one described above with reference to FIG. 2 may be provided for, since the construction of the control device controlling the transverse movement of the cameras does not represent an essential characteristic of the present invention. For example, instead of control devices mechanically connected to each other, control devices may be provided which are electronically synchronized with each other so as to be able to move the cameras simultaneously in the transverse direction.

Figure 5:
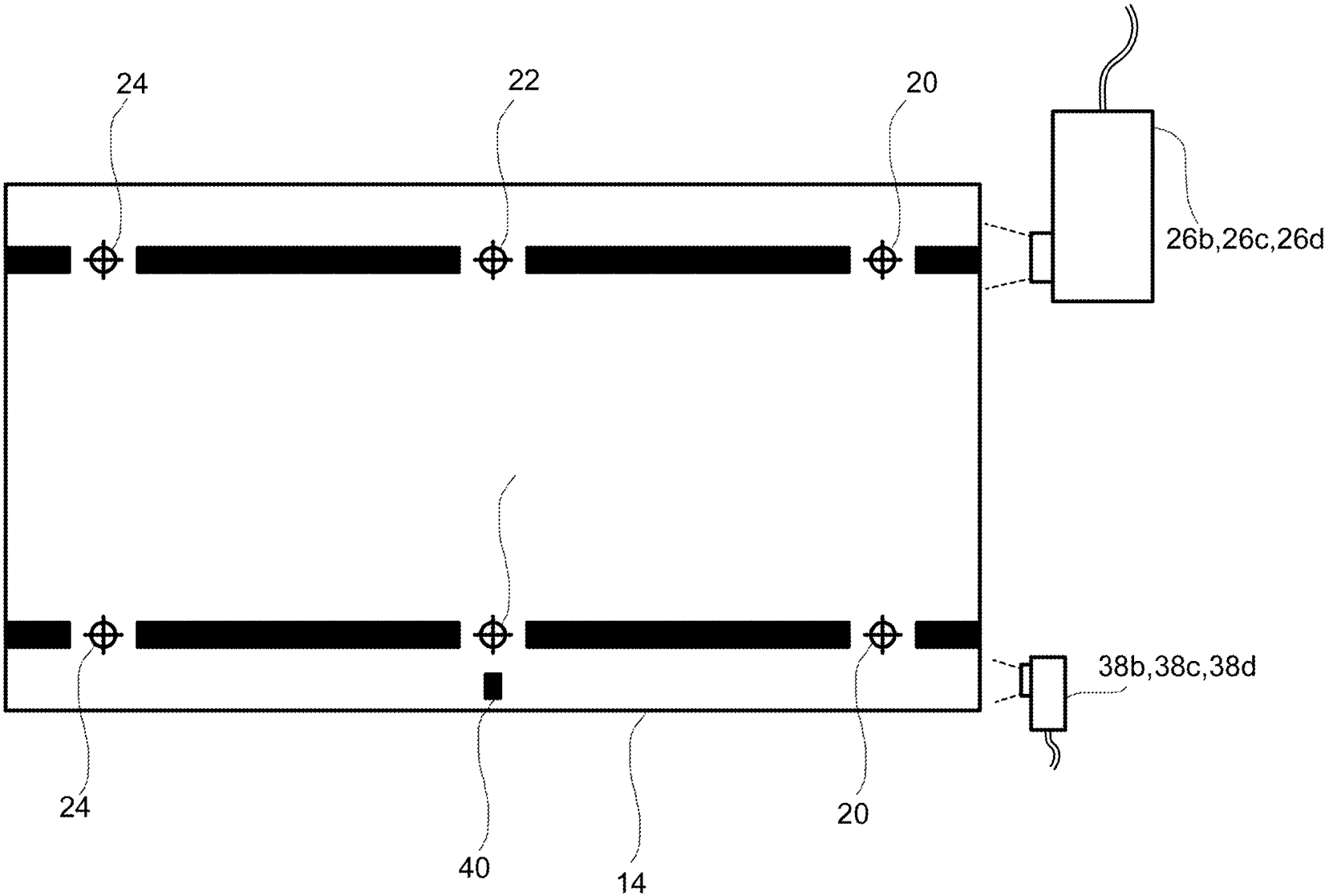
FIG. 5 schematically shows a camera and a photocell associated to one of the printing units of a printing machine according to another embodiment of the invention.

In a printing machine according to the invention, the identification of the register marks 22 (i.e. of the register marks that are used to register the printing units and are therefore the only ones that have to be framed by the cameras) can be carried out both using photocells, as is the case with the known machines, and using the cameras themselves. In the first case, as is shown in FIG. 5, a respective photocell 38*b*, 38*c* and 38*d* arranged to detect the presence of an identifying mark 40 aligned with the register mark 22*a* is associated to each of the cameras 26*b*, 26*c* and 26*d*. In this way, when the photocell detects the presence of the identifying mark the camera coupled thereto frames the register mark aligned with the identifying mark and shows it on the display. In the second case, as is shown in FIG. 3 and FIGS. 4*a* to 4*c*, the register marks 22 are located by means of suitable graphic signs (indicated 42) that are printed by the various printing units of the machine along the same lateral portion of the web of material 14 on which the register marks 22 are printed, immediately upstream and downstream of the register marks 22, and that can therefore be framed by the cameras 26*b*, 26*c* and 26*d*. In this way, when the camera (which naturally frames continuously, i.e. with no interruptions, the web of material moving in front of its objective) recognizes the graphic sign 42, the image of the register mark framed by the camera immediately after the graphic sign 42 is shown on the display. This second solution allows therefore to save the cost for the photocells, as well as to avoid the need to ensure that all the photocells are aligned with each other, but on the other hand requires more sophisticated cameras.

As clearly results from the above description, the registering operation of the printing machine 10 according to the invention is carried out as follows.

First of all the user checks the correct transverse positioning of the cameras 26*b*, 26*c* and 26*d* relative to the web of material 14 and, if necessary, adjusts the transverse position of the cameras by means of the control device 30.

The user starts then the printing machine, preferably at low speed, and checks first the registering of the second printing unit 12*b*, by switching on the associated camera 26*b* so that the image provided by that camera is shown on the display 28. If the second printing unit 12*b* is not correctly registered, the user changes manually, in a suitable manner depending on the amount and direction of the misalignment between the register mark 22 printed by the second printing unit 12*b* and the register mark 22 printed by the first printing unit 12*a*, the position of the printing cylinder 16*b* of the second printing unit 12*b* until a perfect alignment of the register mark 22 printed by the second printing unit 12*b* with the register mark 22 printed by the first printing unit 12*a* is obtained. The user proceeds then likewise with the registering of the other printing units 12*c* and 12*d*. Once this first phase of the registering operation has been completed, the user increases the speed of the printing machine, for example up to the normal working speed, and checks again, in the above-described manner, the registering of the printing units 12*b*, 12*c* and 12*d*, correcting the positions thereof, if necessary.

Naturally, the principle of the invention remaining unchanged, the embodiments and the constructional details may vary widely from those described and illustrated purely by way of non-limiting example.

For example, although in the embodiment proposed here the printing machine comprises one camera for each printing unit, or better for each printing unit starting from the second one, a lower number of cameras (for example one camera for each group of two or three printing units) might alternatively be provided for, in order to reduce the overall cost of the printing machine, while retaining the above-mentioned advantages in terms of greater ease and higher speed in carrying out the registering operation of the machine compared to the prior art.

The invention claimed is:

1. Rotary printing machine with manually-adjustable print register, comprising a plurality of printing units each of which is arranged to transfer an image of a given colour on a web of material while the web of material is being moved forward continuously along a longitudinal direction, each of said printing units comprising a respective printing cylinder, first manually-operated adjustment means arranged to allow a user to adjust manually the position of each printing cylinder so as to move the image printed by that cylinder in two perpendicular adjustment directions, namely in said longitudinal direction and in a transverse direction, relative to the web of material, image acquisition means arranged to acquire images of register marks printed by the printing units along one or both sides of the web of material, wherein said image acquisition means comprise a plurality of cameras each of which is arranged to frame, after a respective printing unit, a portion of web of material where the register marks are printed, second adjustment means arranged to allow the user to adjust simultaneously the position of each of the plurality of cameras in the transverse direction, wherein the second adjustment means comprise a control device comprising a plurality of racks, each one of the plurality of racks is drivingly connected for translation in the transverse direction with a respective camera and a corresponding plurality of pinions drivingly connected for rotation with each other by means of a shaft, and display means arranged to show, on an enlarged scale, the images acquired by said image acquisition means so as to allow the user to detect any misalignments between the register marks printed by the printing units and to properly adjust, through said first adjustment means, the position of one or more printing cylinders to clear said misalignments.

2. Printing machine according to claim 1, wherein said image acquisition means comprise one camera for each printing unit starting from the second one.

3. Printing machine according to claim 1, wherein said display means comprise a display arranged to show each time the images acquired by one of the cameras.

4. Printing machine according to claim 1, wherein said display means comprise, for each camera, a respective display arranged to show the images acquired by the associated camera.

5. Printing machine according to claim 1, further comprising, for each camera, a respective photocell arranged to detect the presence of an identifying mark printed on the web of material near each register mark.

* * * * *